US007643022B2

(12) United States Patent
Kang

(10) Patent No.: US 7,643,022 B2
(45) Date of Patent: Jan. 5, 2010

(54) PANEL SOURCE DRIVER CIRCUITS HAVING COMMON DATA DEMULTIPLEXING AND METHODS OF CONTROLLING OPERATIONS OF THE SAME

(75) Inventor: Chang-sig Kang, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 623 days.

(21) Appl. No.: 11/268,781

(22) Filed: Nov. 8, 2005

(65) Prior Publication Data

US 2006/0208990 A1 Sep. 21, 2006

(30) Foreign Application Priority Data

Nov. 8, 2004 (KR) ..... 10-2004-0090441

(51) Int. Cl.
*G09G 5/00* (2006.01)
*G09G 3/30* (2006.01)

(52) U.S. Cl. ..... 345/204; 345/100

(58) Field of Classification Search ..... 345/204, 345/100

See application file for complete search history.

(56) References Cited

U.S. PATENT DOCUMENTS 5,061,920 A 10/1991 Nelson ..... 340/784
2005/0116918 A1* 6/2005 Shin ..... 345/100

FOREIGN PATENT DOCUMENTS

| | | |
|---|---|---|
| JP | 05-249928 | 9/1993 |
| KR | 100260536 | 7/2000 |
| KR | 1020020004513 | 1/2002 |

* cited by examiner

*Primary Examiner*—Amare Mengistu
*Assistant Examiner*—Joseph G Rodriguez
(74) *Attorney, Agent, or Firm*—Myers Bigel Sibley & Sajovec, P.A.

(57) ABSTRACT

Panel source driver circuits include a first data register and a second data register. A common data demultiplexer coupled to the first and second data registers is configured to provide control data from a first input of the demultiplexer to the first data register and control data from a second input of the demultiplexer to the second data register in a first operation mode and to provide control data from the second input to the first data register and control data from the first input to the second register in a second operation mode responsive to an operation mode select signal. A first decoder is coupled to an output of the first data register that is configured to select one of a plurality of first voltages having different levels responsive to the output of the first data register and to output the selected first voltage. A second decoder is coupled to an output of the second data register that is configured to select one of a plurality of second voltages having different levels in response to the output of the second data register and to output the selected second voltage.

9 Claims, 2 Drawing Sheets

PANEL SOURCE DRIVER CIRCUITS HAVING COMMON DATA DEMULTIPLEXING AND METHODS OF CONTROLLING OPERATIONS OF THE SAME

CROSS-REFERENCE TO RELATED APPLICATIONS

This application is related to and claims priority from Korean Patent Application No. 10-2004-0090441, filed on Nov. 8, 2004, in the Korean Intellectual Property Office, the disclosure of which is incorporated herein by reference in its entirety.

BACKGROUND OF THE INVENTION

The present invention relates to panel source drivers for driving a panel, and more particularly, to panel source drivers having a data register structure that uses demultiplexing and methods of controlling thereof.

To drive a panel, such as, a liquid crystal display (LCD) panel, a source driver and a gate driver are generally required. FIG. 1 is a schematic block diagram of a conventional panel source driver. As shown in FIG. 1, the conventional panel source driver includes a plurality of data registers 111-122, a plurality of first demultiplexers 131-136, a plurality of P-type decoders 141, 143, . . . , and 151, a plurality of N-type decoders 142, 144, . . . , and 152, a plurality of second demultiplexers 161-166, and a plurality of buffers 171-182.

In FIG. 1, a 6-channel unit is illustrated. In other words, six data inputs D1-D6 are repetitively input to six data registers. For example, the six data inputs D1-D6 are input to the six data registers 111-116, respectively, and to the other six data registers 117-122, respectively.

SEL denotes a selection signal for selecting either a first or a second operation mode. VH1-VH256 denote a plurality of high voltages having different levels, and VL1-VL256 denote a plurality of low voltages having different levels. VH1-VH256 and VL1-VL256 are generated by a voltage generator (not shown). Outputs CH1-CH12 of the buffers 171-182 are used to drive sources of a panel.

In the conventional source driver illustrated in FIG. 1, the first demultiplexers 131-136 are interposed between the data registers 111-122 and the P-type and N-type decoders 141-152, such that driver cell sizes (including data registers, first and second demultiplexers, decoders, and buffers) are increased. Thus, a chip area for forming the conventional structure may increase.

SUMMARY OF THE INVENTION

In some embodiments of the present invention, panel source driver circuits include a first data register and a second data register. A common data demultiplexer coupled to the first and second data registers is configured to provide control data from a first input of the demultiplexer to the first data register and control data from a second input of the demultiplexer to the second data register in a first operation mode and to provide control data from the second input to the first data register and control data from the first input to the second register in a second operation mode responsive to an operation mode select signal. A first decoder is coupled to an output of the first data register. The first decoder is configured to select one of a plurality of first voltages having different levels responsive to the output of the first data register and to output the selected first voltage. A second decoder is coupled to an output of the second data register. The second decoder is configured to select one of a plurality of second voltages having different levels in response to the output of the second data register and to output the selected second voltage.

In other embodiments of the present invention, the output of the first data register is coupled to the first decoder without a demultiplexer therebetween and the output of the second data register is coupled to the second decoder without a demultiplexer therebetween. The first decoder may be directly coupled to the output of the first data register and the second decoder may be directly coupled to the output of the second data register.

In further embodiments of the present invention, a second demultiplexer is coupled to the output of the first decoder and to the output of the second decoder. The second demultiplexer is configured to couple the output of the first decoder to a first output port of the second demultiplexer and to couple the output of the second decoder to a second output port of the second demultiplexer in the first operation mode and to couple the output of the first decoder to the second output port of the second demultiplexer and to couple the output of the second decoder to the first output port of the second demultiplexer in the second operation mode. A first buffer may be coupled to the first output port of the second demultiplexer and a second buffer may be coupled to the second output port of the second demultiplexer.

In other embodiments of the present invention, the panel source driver is a six channel unit. Each channel includes a first data register, a second data register, a first decoder and a second decoder and the common data demultiplexer is coupled to the first and second data registers of each of the channels. A first plurality of voltage inputs to the first decoder may provide the plurality of first voltages and a second plurality of voltage inputs to the second decoder may provide the plurality of second voltages.

In yet further embodiments of the present invention, methods of controlling operation of a panel source driver are provided. The panel source driver includes: a first data register; a second data register; a first decoder selecting one of a plurality of first voltages having different levels in response to an output of the first data register and outputting the selected first voltage; and a second decoder selecting one of a plurality of second voltages having different levels in response to an output of the second data register and outputting the selected second voltage. The methods include providing control data from a first source to the first data register to specify the output of the first data register and control data from a second source to the second data register to specify the output of the second data register in a first operation mode. Control data from the first source is provided to the second data register to specify the output of the second data register and control data from the second source is provided to the first data register to specify the output of the first data register in a second operation mode.

In other embodiments, the panel source driver further includes a first buffer buffering the output of the first decoder or the output of the second decoder and outputting a buffering result and a second buffer buffering the output of the first decoder or the output of the second decoder and outputting a buffering result. The methods may further include outputting the output of the first decoder via a first output port of the panel source driver and the output of the second decoder via a second output port of the panel source driver in the first operation mode and outputting the output of the first decoder via the second output port and the output of the second decoder via the first output port in the second operation mode.

BRIEF DESCRIPTION OF THE DRAWINGS

The above and other features and advantages of the present invention will become more apparent by describing exemplary embodiments thereof with reference to the attached drawings in which.

DETAILED DESCRIPTION OF THE INVENTION

Figure 1:
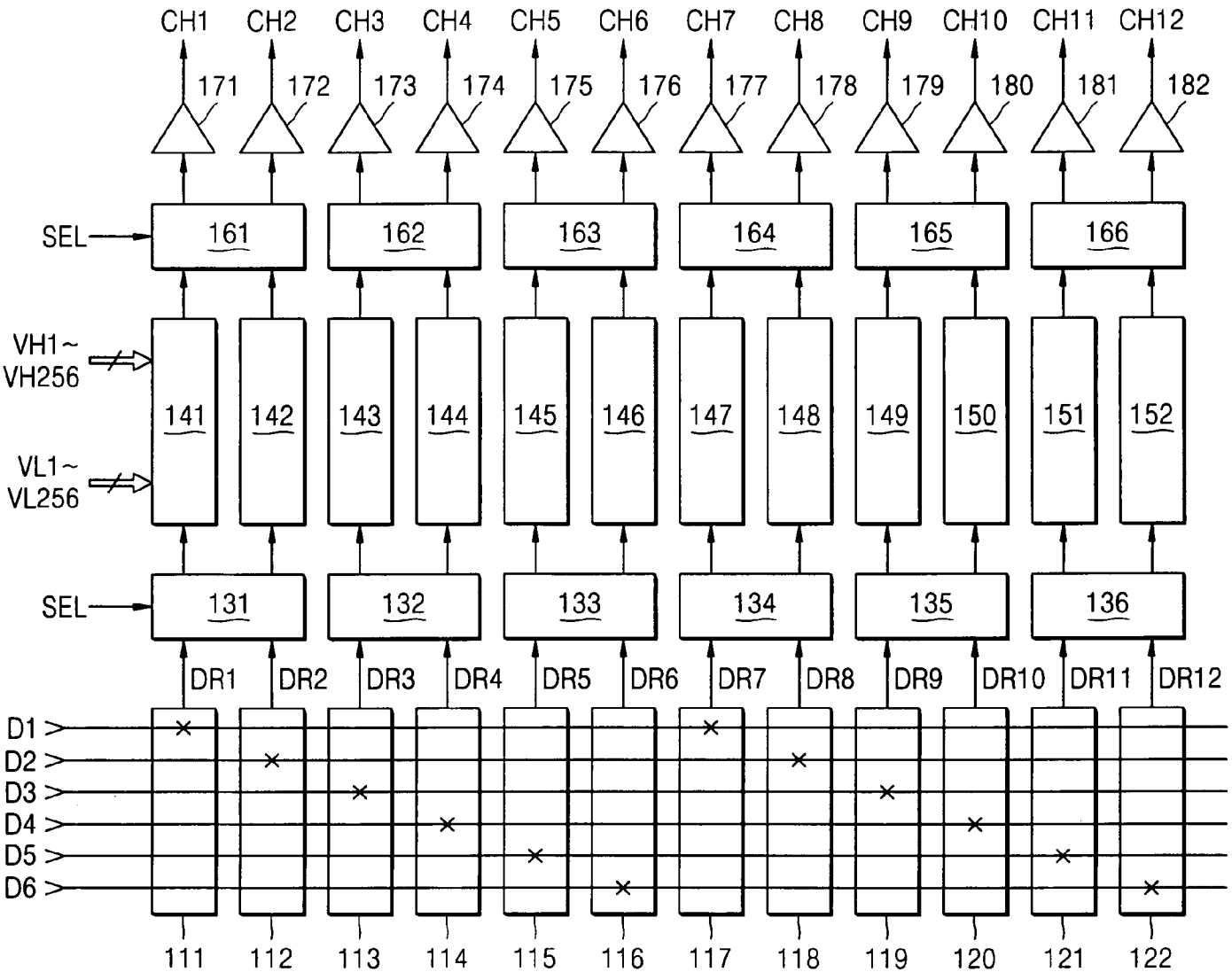
FIG. 1 (PRIOR ART)
FIG. 1 is a schematic block diagram of a conventional panel source driver.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
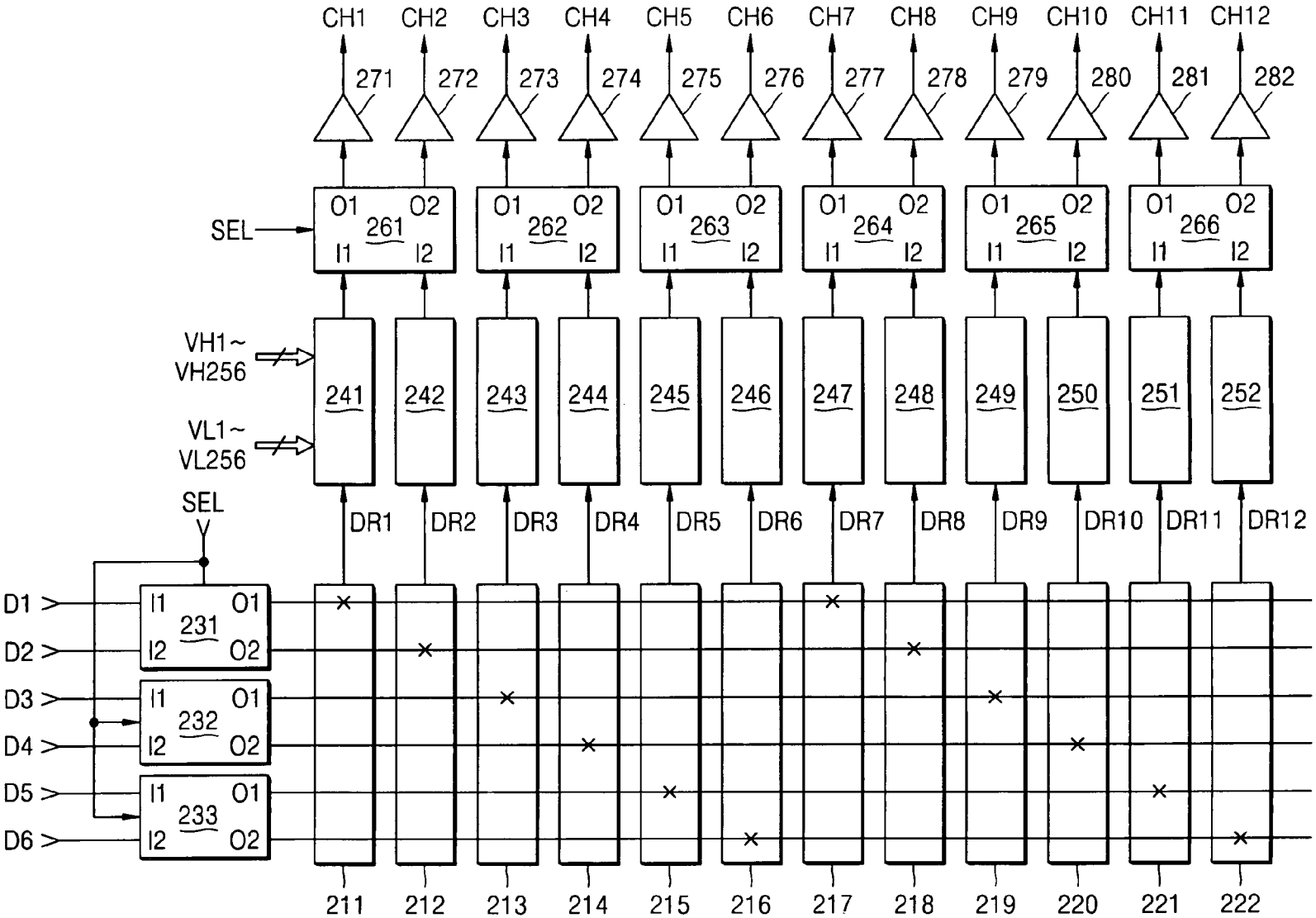
FIG. 2 is a block diagram of a panel source driver according to some embodiments of the present invention.

FIG. 2 is a block diagram illustrating a panel source driver according to some embodiments of the present invention. The panel source driver may be utilized with an operation mode controlling method using common data demultiplexing according to some embodiments of the present invention.

Referring to the FIG. 2, some embodiments of a panel source driver include a plurality of data registers 211-222, a plurality of common data demultiplexers 231-233, a plurality of P-type decoders 241, 243, . . . , and 251, a plurality of N-type decoders 242, 244, . . . , and 252, a plurality of output demultiplexers 261-266, and a plurality of buffers 271-282.

For illustrative purposes, a 6-channel unit is shown in FIG. 2. In other words, six outputs of the common data demultiplexers 231-233 are repetitively input to six data registers. For example, the six outputs of the common data demultiplexers 231-233 are input to the six data registers 211-216, respectively, and to the other six data registers 217-222, respectively, as indicated by the "X" marks in the data registers 211-222.

In a first operation mode, the common data demultiplexers 231-233 output first control data D1, D3, and D5, respectively, which are input via first input ports I1 and output via first output ports O1, and output second control data D2, D4, and D6, respectively, which are input via second input ports I2 and output via second output ports O2. On the other hand, in a second operation mode, the common data demultiplexers 231-233 output first control data D1, D3, and D5, respectively, which are input via first input ports I1 and output via the second output ports O2, and output second control data D2, D4, and D6, respectively, which are input via second input ports I2 and output via first output ports O1.

SEL denotes a selection signal for selecting one of first and second operation modes. To select the first operation mode, the selection signal SEL is in a first logic state, for example, logic high. To select the second operation mode, the selection signal SEL is in a second logic state, for example, logic low.

Control data output by the first and second output ports O1 and O2 of each of the common data demultiplexers 231-233 are provided to two adjacent data registers. For example, control data output via the first output port O1 of the common data demultiplexer 231 is provided to the first data register 211, and control data output via the second output port O2 of the common data demultiplexer 231 is provided to the second data register 212, which is adjacent to the first data register 211.

Each of the P-type decoders 241, 243, . . . , and 251 selects one of a plurality of high voltages VH1-VH256 having different levels in response to an output DRi of a corresponding data register of the data registers 211, 213, . . . , and 221. Each of the N-type decoders 242, 244, . . . , and 252 selects one of a plurality of low voltages VL1-VL256 having different levels in response to an output DRi of a corresponding data register of the data registers 212, 214, . . . , and 222. The voltages VH1-VH256 and VL1-VL256 are generated, for example, by a voltage generator (not shown).

In the first operation mode, each of the output demultiplexers 261-266 outputs an output of a corresponding P-type decoder of the P-type decoders 241, 243, . . . , and 251 coupled thereto via a first output port O1 and an output of a corresponding N-type decoder of the N-type decoders 242, 244, . . . , and 252 coupled thereto via a second output port O2. On the other hand, in the second operation mode, each of the output demultiplexers 261-266 outputs the output of the corresponding P-type decoder of the P-type decoders 241, 243, . . . , and 251 coupled thereto via the second output port O2 and the output of the corresponding N-type decoder of the N-type decoders 242, 244, . . . , and 252 coupled thereto via the first output port O1. The output demultiplexers 261-266 are controlled by the selection signal SEL similarly to the common data demultiplexers 231-233.

The first buffers 271, 273, . . . , and 281 receive signals from first output ports O1 of the output demultiplexers 261-266, respectively, buffer the signals, and output the buffered signals. The second buffers 272, 274, . . . , and 282 receive signals from second output ports O2 of the output demultiplexers 261-266, respectively, buffer the signals, and output the buffered signals. Outputs CH1-CH12 of the buffers 171-182 may be used to drive sources of a panel.

Each of the control data D1-D6 may include a plurality of bits. Each of the outputs DR1-DR12 of the data registers 211-222 may also include a plurality of bits.

As described above, the panel source driver of FIG. 2 may perform the same function as the conventional panel source driver of FIG. 1. However, the embodiments of FIG. 2 use the three common data demultiplexers 231-233 instead of the first demultiplexers 131-136 illustrated in the conventional panel source driver of FIG. 1. In other words, the panel source driver of the embodiments of FIG. 2 does not include the first demultiplexers 131-136 interposed between the data registers 111-122 and the decoders 141-152 that are used in the conventional panel source driver of FIG. 1. As such, the heights of respective driver cells (including data registers, first and second demultiplexers, decoders, and buffers) may be decreased.

As described above, in panel source drivers and methods of controlling an operation mode of the panel source drivers according to some embodiments of the present invention, demultiplexers interposed between data registers and decoders in a conventional panel source driver are removed by using common data demultiplexing. As a result, the areas of driver cells may decrease, and a chip area used may decrease.

Some embodiments of the present invention provide a panel source driver having a data register structure that uses common data demultiplexing to reduce a height of a driver cell. Methods of controlling an operation mode of the panel source driver are also provided that use common data demultiplexing to reduce a height of a driver cell.

According to some embodiments of the present invention, there is provided a panel source driver including: a first data register; a second data register; a first demultiplexer, a first decoder, a second decoder, a second demultiplexer, a first buffer, and a second buffer. The first demultiplexer provides first control data and second control data to the first and second data registers, respectively, in a first operation mode, and provides the first control data and second control data to the second and first data registers, respectively, in a second operation mode. The first decoder selects one of a plurality of first voltages having different levels in response to an output of the first data register and outputs the selected first voltage. The second decoder selects one of a plurality of second voltages having different levels in response to an output of the second data register and outputs the selected second voltage.

In some embodiments, in the first operation mode, the second demultiplexer outputs the output of the first decoder via a first output port and the output of the second decoder via a second output port. In the second operation mode, the second demultiplexer outputs the output of the first decoder via the second output port and the output of the second decoder via the first output port in the second operation mode. The first buffer may buffer a signal of the first output port and output the buffered signal. The second buffer may buffer a signal of the second output port and output the buffered signal.

In further embodiments of the present invention, methods of controlling an operation mode of a panel source driver are provided, the panel source driver including: a first data register; a second data register; a first decoder selecting one of a plurality of first voltages having different levels in response to an output of the first data register and outputting the selected first voltage; a second decoder selecting one of a plurality of second voltages having different levels in response to an output of the second data register and outputting the selected second voltage; a first buffer buffering the output of the first decoder or the output of the second decoder and outputting a buffering result; and a second buffer buffering the output of the first decoder or the output of the second decoder and outputting a buffering result. The operation mode controlling methods include providing first control data and second control data to the first and second data registers, respectively, in a first operation mode, and providing the first control data and second control data to the second and first data registers, respectively, in a second operation mode.

The operation mode controlling methods may further include outputting the output of the first decoder via a first output port and the output of the second decoder via a second output port in the first operation mode and outputting the output of the first decoder via the second output port and the output of the second decoder via the first output port in the second operation mode.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A panel source driver circuit, comprising:

a first data register;

a second data register;

a common data demultiplexer coupled to the first and second data register that is configured to provide control data from a first input of the demultiplexer to the first data register and control data from a second input of the demultiplexer to the second data register in a first operation mode and to provide control data from the second input to the first data register and control data from the first input to the second register in a second operation mode responsive to an operation mode select signal;

wherein a single portion of the common data demultiplexer controlled by the operation mode select signal provides control data to at least a pair of data registers;

a first decoder coupled to an output of the first data register that is configured to select one of a plurality of first voltages having different levels responsive to the output of the first data register and to output the selected first voltage; and a second decoder coupled to an output of the second data register that is configured to select one of a plurality of second voltages having different levels in response to the output of the second data register and to output the selected second voltage.

2. The panel source driver of claim 1 wherein the first decoder is directly coupled to the output of the first data register and wherein the second decoder is directly coupled to the output of the second data register.

3. The panel source driver of claim 1, further comprising:

a second demultiplexer coupled to the output of the first decoder and to the output of the second decoder that is configured to couple the output of the first decoder to a first output port of the second demultiplexer and to couple the output of the second decoder to a second output port of the second demultiplexer in the first operation mode and to couple the output of the first decoder to the second output port of the second demultiplexer and to couple the output of the second decoder to the first output port of the second demultiplexer in the second operation mode;

a first buffer coupled to the first output port of the second demultiplexer; and a second buffer coupled to the second output port of the second demultiplexer.

4. The panel source of claim 1, wherein the panel source driver comprises a six channel unit, wherein each channel includes a first data register, a second data register, a first decoder and a second decoder and wherein the common data demultiplexer is coupled to the first and second data registers of each of the channels.

5. The panel source of claim 1, further comprising a first plurality of voltage inputs to the first decoder that provide the plurality of first voltages and a second plurality of voltage inputs to the second decoder that provide the plurality of second voltages.

6. The panel source of claim 1, wherein the output of the first data register is coupled to the first decoder without a demultiplexer therebetween and wherein the output of the second data register is coupled to the second decoder without a demultiplexer therebetween.

7. A method of controlling operation of a panel source driver, the panel source driver including: a first data register; a second data register; a first decoder selecting one of a plurality of first voltages having different levels in response to an output of the first data register and outputting the selected first voltage; and a second decoder selecting one of a plurality of second voltages having different levels in response to an output of the second data register and outputting the selected second voltage, the method comprising:

providing control data from a first source to the first data register to specify the output of the first data register and control data from a second source to the second data register to specify the output of the second data register in a first operation mode; and providing control data from the first source to the second data register to specify the output of the second data register and control data from the second source to the first data register to specify the output of the first data register in a second operation mode;

wherein a single portion of a common data demultiplexer controlled by the mode of operation provides the control data as the first and second sources as control data to the first and second data registers.

8. The method of claim 7, wherein the panel source driver further includes a first buffer buffering the output of the first decoder or the output of the second decoder and outputting a buffering result and a second buffer buffering the output of the first decoder or the output of the second decoder and outputting a buffering result.

9. The method of claim 8, further comprising:

outputting the output of the first decoder via a first output port of the panel source driver and the output of the second decoder via a second output port of the panel source driver in the first operation mode; and outputting the output of the first decoder via the second output port and the output of the second decoder via the first output port in the second operation mode.

* * * * *